United States Patent [19]

Wilson

[11] 4,342,558

[45] Aug. 3, 1982

[54] HYDROFOIL SWIM FIN ASSEMBLIES

[76] Inventor: Wayne Wilson, 153 1/2 N. 600 West, Salt Lake City, Utah 84116

[21] Appl. No.: 140,338

[22] Filed: Apr. 14, 1980

Related U.S. Application Data

[63] Continuation-in-part of Ser. No. 965,314, Feb. 2, 1979, abandoned.

[51] Int. Cl.[3] ..... A63B 31/10

[52] U.S. Cl. ..... 441/61

[58] Field of Search ..... 9/301, 303–306, 9/309; 244/219, 219 A

[56] References Cited

U.S. PATENT DOCUMENTS

| | | | |
|---|---|---|---|
| 2,979,287 | 4/1961 | Ross | 244/219 A |
| 3,078,482 | 2/1963 | Crowder | 9/309 |
| 3,171,142 | 3/1965 | Auzols | 9/309 |
| 3,665,535 | 5/1972 | Picken | 9/309 |

FOREIGN PATENT DOCUMENTS

| | | | |
|---|---|---|---|
| 2374208 | 8/1978 | France | 244/219 A |

*Primary Examiner*—Sherman D. Basinger
*Attorney, Agent, or Firm*—Lynn G. Foster

[57] ABSTRACT

Hydrofoil swim fin assemblies, each assembly comprising a streamlined foot housing and a separate hydrofoil blade mechanism which is pivotably connected to the foot housing so that by rotation the angle of attack of the blade is reversed between each up and each down leg stroke of the swimmer. Furthermore, the sail portion of the blade mechanism is flexed at the beginning of each stroke, so as to be convex on the top and concave on the bottom during the down-stroke and visa versa during the up-stroke. Thus, the forward propulsion of the swimmer is enhanced by hydrofoil action during both the up and the down strokes.

10 Claims, 8 Drawing Figures

Fig. 1
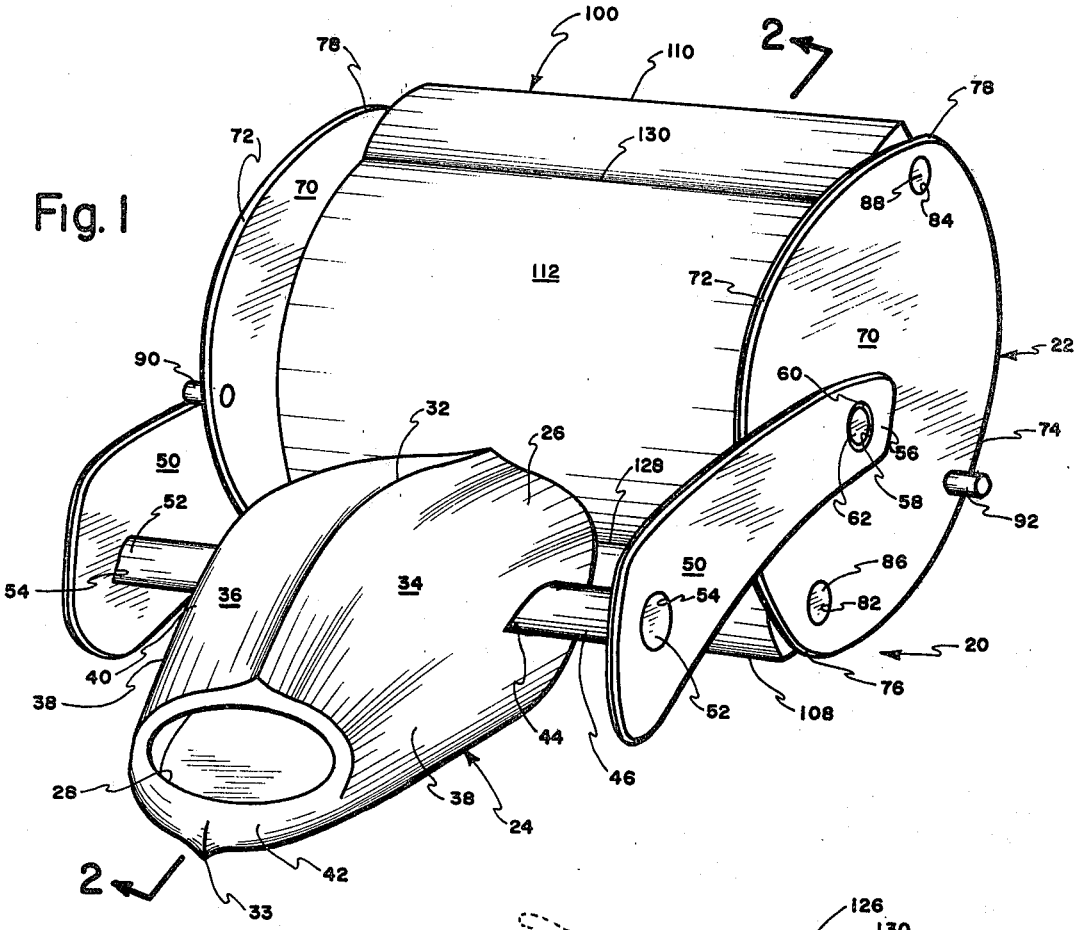
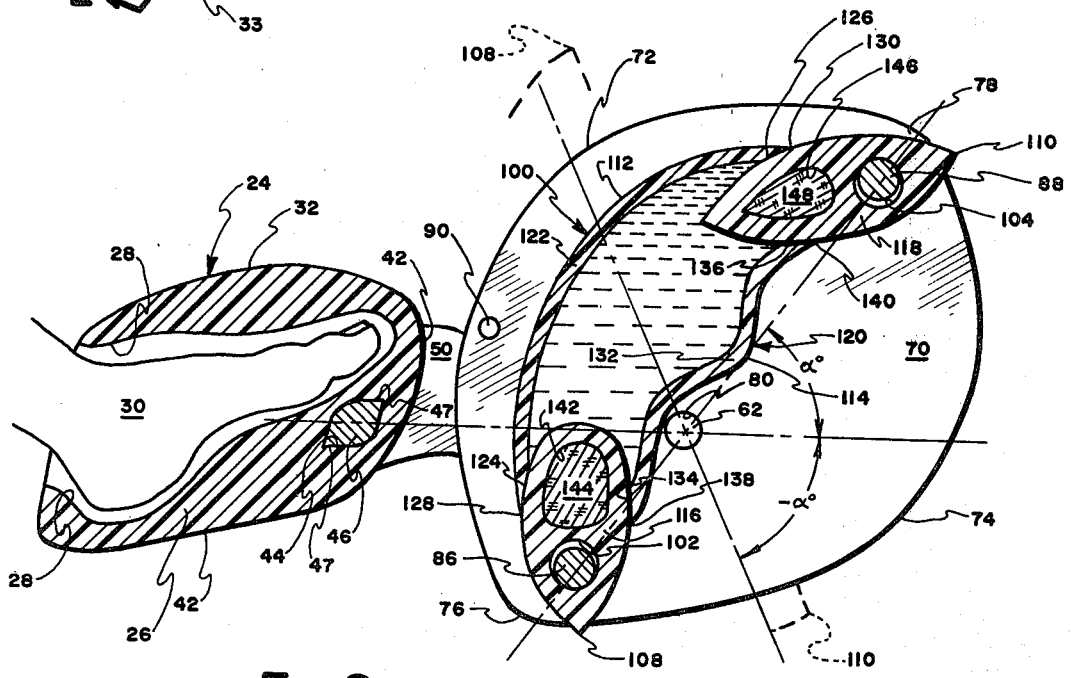
Fig. 2

HYDROFOIL SWIM FIN ASSEMBLIES

This is a continuation-in-part of Ser. No. 965,314 filed Feb. 2, 1979, and now abandoned.

BACKGROUND

1. Field of Invention

The present invention relates generally to aids for swimmers and more particularly to hydrofoil swim fin assemblies comprising a foot housing and a pivotally connected hydrofoil blade mechanism which enhances by hydrofoil action the forward propulsion of the swimmer during both the up and down-strokes of the leg.

2. Prior Art

Various modifications to and deviations from the well known swim flipper have been proposed to help propel the user through the water. The proposals in question may be classified into two groups. The first group involves the use of various types of pivotable vanes, valves or baffles which aid the swimmer during the up-stroke or during the down-stroke, but not both. See U.S. Pat. Nos. 805,515; 2,557,367; 3,081,467 and 3,952,351. None of these proposals provide hydrofoil action and none two-way hydrofoil action.

The second group involves use of hinged flippers. See U.S. Pat. No. 4,025,977 and French Pat. No. 1,208,636. Neither provides hydrofoil action, neither provides two-way hydrofoil action, neither provides the separate blade with an exposed leading edge and each requires a substantial foot and ankle movement to implement the hinge action, as opposed to utilization of mere water resistance.

BRIEF SUMMARY AND OBJECTS OF THE INVENTION

In brief summary, the present invention comprises hydrofoil swim fin assemblies, each assembly comprising hydrofoil blade structure rotatably carried by a foot housing, the blade structure having an exposed leading edge and a flexible central portion, which changes curvature due to water resistance at the beginning of each up and each down stroke as the blade rotates in respect to the foot housing to reverse the angle of attack of the blade whereby propulsion of the swimmer using the assembly is enhanced during both the up-stroke and the down-stroke due to hydrofoil action.

With the foregoing in mind, it is a primary object of the present invention to provide a novel hydrofoil swim fin assembly.

A further important object of the present invention is the provision of a hydrofoil swim fin assembly comprising hydrofoil blade structure having an exposed leading edge and being rotatably carried by a foot housing.

An additional paramount object of the present invention is the provision of a hydrofoil swim fin assembly comprising a hydrofoil blade mechanism comprising a flexible central portion which changes curvature due to water resistance at the beginning of each up-stroke and each down-stroke.

An additional dominant object of the present invention is the provision of novel hydrofoil swim fin assemblies the blade of which rotates and flexes to change it's curvature whereby forward displacement of the swimmer in water is enhanced during both the up and down-strokes.

A further object of the present invention is the provision of a novel hydrofoil swim fin assemblies which are uniquely configurated to reduce drag particularly along the edges thereof.

These and other objects and features of the present invention will be apparent from the detailed description taken with reference to the accompanying drawings.

BRIEF DESCRIPTION OF THE DRAWINGS

FIG. 1 is a perspective representation of one presently preferred foot carried pivotable hydrofoil blade assembly for a swimmer, according to the present invention;

FIG. 2 is a cross sectional view of the hydrofoil blade assembly of FIG. 1 taken along line 2—2 thereof;

DETAILED DESCRIPTION OF THE ILLUSTRATED EMBODIMENTS

Figure 3:
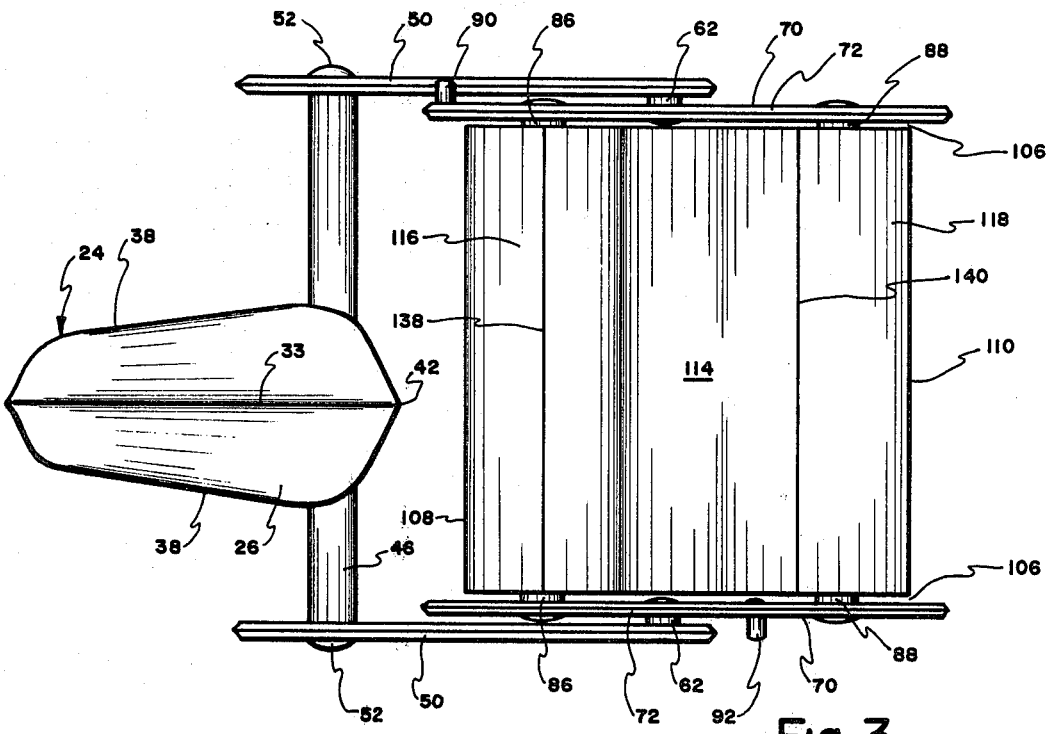
FIG. 3 is a bottom plan view of the hydrofoil blade assembly of FIG. 1.

Reference is now made to the drawings wherein like numerals are used to designate like parts throughout. FIGS. 1–3 illustrate one presently preferred foot carried pivotable hydrofoil blade assembly for a swimmer, generally designated 20, according to the present invention. Use of the hydrofoil blade assembly 20 accommodates automatic changing of position and flexing of a trailing hydrofoil mechanism, generally designated 22, at commencement of each up-stroke and each down stroke by the leg of a swimmer, the foot of the swimmer being secured in an elastomeric foot housing, generally designated 24.

Propulsion of the swimmer through the water is substantially enhanced by the hydrofoil effect across the then existing convex surface of the hydrofoil mechanism 22 during both the up-stroke and the down-stroke as the hydrofoil blade mechanism 22 shifts position and flexes, as hereinafter more fully explained. The position shift and flexing are illustrated when comparing the solid and dotted line positions of the hydrofoil blade mechanism 22 in FIG. 2. Contrast the angle alpha with the angle minus alpha. Typically alpha and minus alpha, the hydrofoil angle, may be seventy degrees (70°). Other angle settings could be used.

The foot-receiving housing 24 is preferably of one piece elastomeric molded construction comprising plastic or rubber and having a streamlined exterior 26 and a foot-receiving cavity 28. The housing 24 is shaped to compliment the hydrofoil effect of the mechanism 22. The foot-receiving cavity 28 is sized and shaped to match the anatomical configuration of a human foot 30. See FIG. 2.

The streamlined exterior 26 of the foot housing 24 comprises an elevated top fin 32, with bottom fin 33, opposed concave surfaces 34 and 36 adjacent the fin 32 which convergently merge with the fin 32. The foot housing 24 further comprises contoured sides 38, which merge at fillet sites 40 with the concavities 34 and 36. The contoured sides 38 curvilinearly merge with a rounded bottom 42.

In addition, the sides 38 forwardly converge to form a central front apex portion 42. Apex portion 42 spans vertically between the front end of the top fin 32 and the front end of the bottom fin 33.

The support rod 46 further may comprise front and back streamlining vanes at sites 47. Rod 46 non-rotatably passes through a transverse opening 44 in the foot housing 24. For example, the foot housing 24 can be molded in place around the foot rod 46. The foot housing 24 as described is streamlined to accommodate easy movement up and down in the water and to allow for the ready smooth displacement of the housing 24 through the water with minimum drag during forward motion to thereby enhance the overall hydrofoil effect of the assembly 20.

A pair of spaced side links 50 rotatably join the foot housing 24 to the trailing hydrofoil blade mechanism 22. More specifically, with the foot housing 24 non-rotatably secured to the rod 46 along the center thereof, the opposed ends 52 of the rod are respectively non-rotatably anchored in apertures 54 provided adjacent the forward lower corner of each connector plate or link 50. The spaced and parallel connector plates 50 are illustrated as being vertically disposed and of uniform thickness. Each plate 50 comprises a trailing end 56 equipped with a hub aperture 58 therein.

The hub aperture 58 in each plate or arm 50 receives a bushing 60 in force-fit relation. A short shaft 62, serving a purpose hereinafter more fully explained, is journaled for rotation in each of the bushings 60. The two short shafts 62 are axially aligned one with the other, the common axis of which forms the axis of rotation for the hydrofoil blade mechanism 22.

The sides of the hydrofoil blade mechanism 22 are defined respectively by parallel relatively thin bracket or side plates 70. Each vertically extending side plate 70 is generally eliptical or oval in configuration as illustrated, presenting a top edge 72 and a bottom edge 74, each of substantially uniform curvature, joined by fore and aft rounded apexes 76 and 78.

Each side plate 70 comprises an eccentric aperture 80 (FIG. 2) in which the interior end of the adjacent short shaft 62 is non-rotatably secured. As best illustrated in FIG. 2, the two short shafts 62 are respectively non-rotatably secured in the adjacent side plate 70 and rotatably journaled in the bushing 60 at the trailing end 56 of the associated bracket 50. Thus, the hydrofoil blade mechanism 22 is free to rotate within the range of plus or minus alpha degrees in respect to side brackets 50.

In addition, each side plate 70 comprises an aperture 82 adjacent the apex 76 and an aperture 84 adjacent the apex 78. The apertures 82 of the two plates 70 are aligned one with the other, as are the two apertures 84. A rigid shaft 86 spans between the apertures 82 and is non-rotatably secured in each. A rigid shaft 88 spans between the two apertures 84 with the ends thereof non-rotatably secured therein.

As viewed in FIG. 1, the left side plate 70 comprises an outwardly extending stop pin 90 located so as to engage the top edge of the left bracket 50 when the hydrofoil plate mechanism 22 has been rotated into the solid line position of FIG. 2 placing the line shown as passing through the shafts 86 and 88 at a plus alpha degree orientation. The right side plate 70 comprises a rigidly secured outwardly projecting stop pin 92 which is located so as to engage the bottom surface of the right bracket 50 to accommodate rotation into the dotted line position illustrated in FIG. 2 disposing the previously mentioned line at a minus alpha degree orientation.

A hydrofoil blade, generally designated 100 is interposed between the side plates 70 and is non-rotatably carried in that disposition upon the transverse shafts 86 and 88. Shafts 86 and 88, however, pass loosely through somewhat larger transverse bores 102 and 104, respectively. This permits the blade 100 to flex. The hydrofoil blade 100 is illustrated as being spaced a short distance 106 from each side plate 70. In cross section, as best viewed in FIG. 2, the hydrofoil blade 100 is wing-shaped and presents a leading edge 108 a trailing edge 110 and a yieldable upper surface 112. Bottom surface 114 also spans between leading edge 108 and trailing edge 110.

The hydrofoil blade 100 comprises, as best viewed in cross section in FIG. 2, a lobe shaped leading end body 116, in which bore 102 is situated, a lobe-shaped trailing end body 118, in which bore 104 is situated and a central portion 120. Central portion 120 comprises a top flexible layer 122 forming surface 112 and being integrally joined at site 124 to the leading lobe body 116 and at site 126 to the trailing lobe body 118. Thus, transverse welds or attachment seams 128 and 130 are exposed to view along the top of the hydrofoil blade 100.

Likewise, central portion 120 of the blade 100 comprises a lower flexible layer 132, which forms the exposed surface 114. Layer 132 is integrally united to the central underside of the leading lobe body 116 at site 134 and centrally to the underside of the trailing lobe body 118 at site 136. Thus, transverse weld or attachment lines 138 and 140 may be visually observed from the bottom.

Approximately one-half of the exterior of the leading lobe body 116 is concealed within the central interior 120 between weld sites 124 and 134. The other approximately one-half of the exterior of the leading lobe body 116 is exposed with approximately one-half comprising a continuation of top surface 112 and the remainder a continuation of the bottom surface 114. Leading lobe body 116 comprises a hollow interior 142 filled with a buoyant material such as cork 144.

It is presently preferred that the material from which leading lobe body 116, trailing lobe body 118, layer 122 and layer 132 are formed is fiber reinforced rubber. However, other suitable elastomeric materials may be used.

Approximately one-half of the exterior surface of the trailing lobe body 118 is concealed within the central interior 120 with the remainder being exposed about half of which comprises a continuation of top surface 112 and the remainder a continuation of bottom surface 114. Trailing lobe body 118 comprises a hollow interior 146 filled with a buoyant material such as cork 148.

The region between top layer 122 and bottom layer 132 is filled with an appropriate substance, such as a liquid, which readily accommodates flexing of the central portion 120.

In use, the foot carried pivotable hydrofoil blade mechanism 20 substantially improves the propulsion efficiency of a swimmer. At the beginning of the downward stroke of each hydrofoil blade mechanism 22, the mechanism 22 is caused to rotate from the dotted line position to the solid line position of FIG. 2 by the water resistance on the underside of the hydrofoil blade 100 to the downward stroke. In this condition, the central portion 120 is caused by the mentioned water resistance to flex upwardly. Thus, the upper layer 122 becomes upwardly convex, while the lower layer 132 is flexed into a generally concave disposition. The loose relation between the shaft 86 and aperture 102 and shaft 86 and aperture 104 accommodate the mentioned flexure.

At the beginning of the upward stroke, the mechanism 22 is caused to be displaced by the resistance of the water to upward movement from the solid line to the dotted line position of FIG. 2. In this condition, the central portion 120 is flexed downwardly. Thus, the upper layer 122 becomes generally concave and the lower layer 132 becomes downwardly convex. As illustrated and described, such rotation of mechanism 22 is between plus and minus alpha degrees, alpha presently being preferred to be on the order of seventy degrees (70°). This provides an angle of attack of twenty degrees (20°) designated by the angle theta in FIG. 2.

As the hydrofoil mechanism is displaced up or down at the desired angle of attack, greater forward thrust is developed due to the thrust component developed by the hydrofoil effect caused by water being displaced more rapidly over the flexed convex surface, with more resistance existing along the underside of the hydrofoil blade 100, flow across the blade being divided substantially equally by displacement of the leading edge 108 through the water in either the solid or dotted positions.

Figure 4:
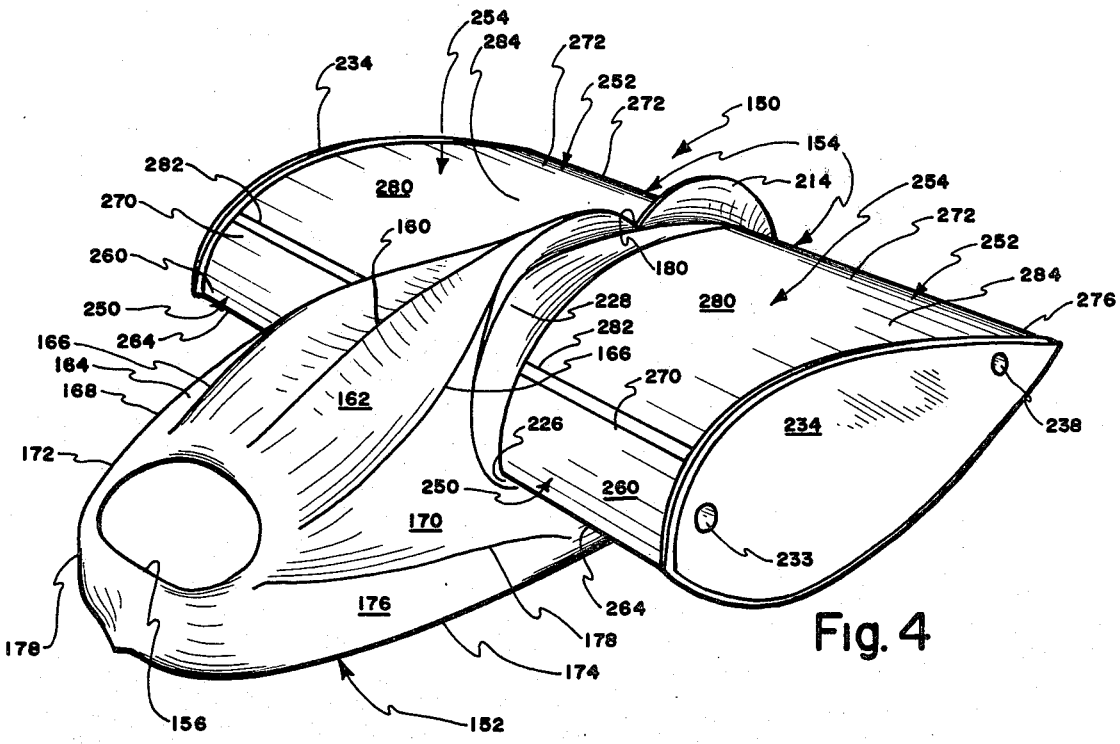
FIG. 4 is a perspective representation of a second presently preferred foot carried pivotable hydrofoil blade assembly for a swimmer, according to the present invention.
Figure 5:
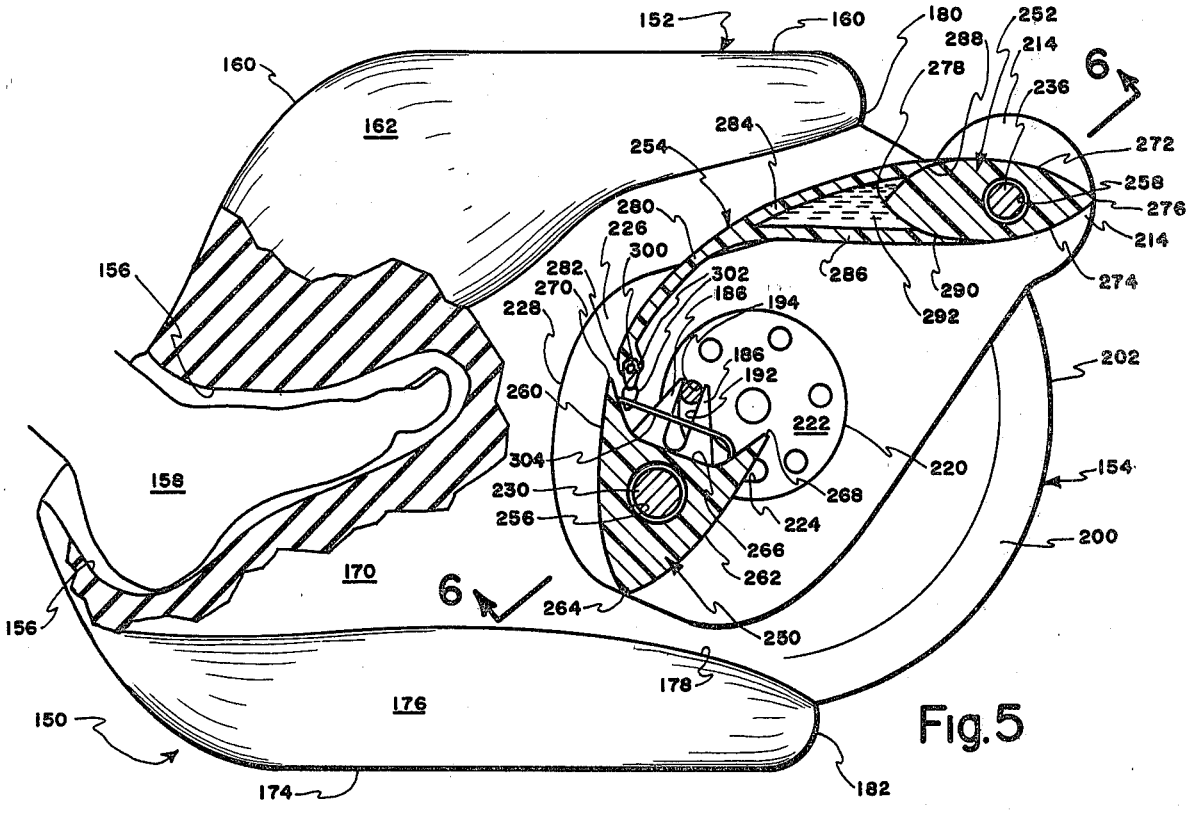
FIG. 5 is a side elevation of the hydrofoil blade assembly of FIG. 4 with some parts broken away and some parts shown in cross section for clarity.
Figure 6:
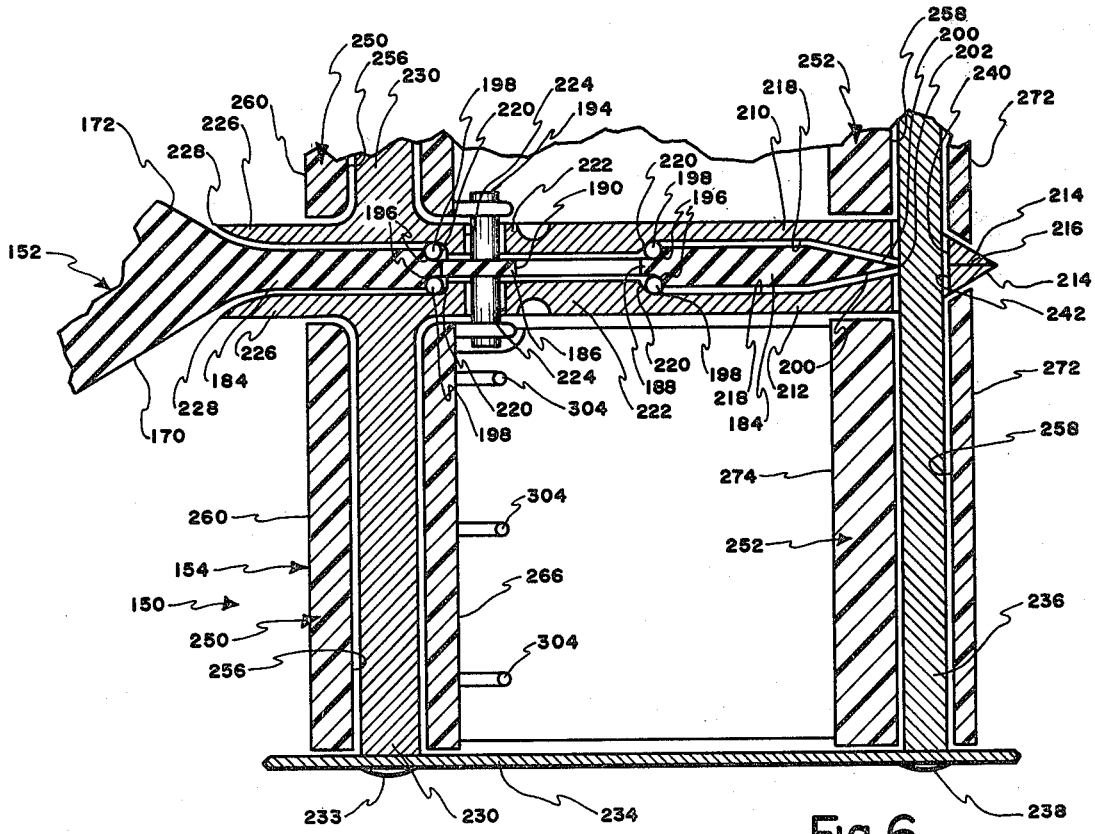
FIG. 6 is a cross sectional view taken along line 6—6 of FIG. 5.

Reference is now made to FIGS. 4–6 which illustrate a second presently preferred foot carried pivotable hydrofoil blade assembly, generally designated 150, in accordance with the present invention. Assembly 150 comprises an elastomeric foot housing, generally designated 152, and a pivotable hydrofoil blade mechanism, generally designated 154.

The foot housing 152 is illustrated as being formed of shape-retaining elastomeric material, such as rubber, and comprises a foot receiving opening or socket 156 shaped and contoured to receive the foot 158 of the user. The exterior of the foot housing 152 is streamline in its configuration, presenting a dorsel fin 160 formed by oppositely directed converging top concave surface areas 162 and 164. Top concave areas 162 and 164 respectively merge at rounded corner 166 and 168 with right and left side surfaces 170 and 172 (as viewed in FIG. 4). The housing 152 also presents a longitudinally directed lower fin 174 formed by opposed concave surface areas 176, which merge at rounded surface sites 178 with the side areas 170 and 172. The housing 152 is designed to enhance the hydrofoil action of the mechanism 154.

As best illustrated in FIG. 5, the top fin 160 extends a substantial distance to the rear and defines a rear rounded top stop surface 180. Likewise, the lower fin 174 extends substantially the same distance to the rear and defines an inwardly directed rounded stop surface 182. Thus, the foot housing 152 by the structure defining the rearwardly extending fins 160 and 174 defines a mouth arrangement in which the hydrofoil blade mechanism 154 is rotatably carried, as hereinafter more fully explained. As best shown in FIG. 6, the rear central portion of the foot housing 152 narrows by convergence of the sidewalls 170 and 172 to a narrow planar bearing or hub disc 184. Disc 184 is of reduced thickness at sites 186 and 188, aperture 190 being defined therebetween. The reduced thickness portion 186 comprises a fork or bifurcation defining a U-shaped slot 192 through which an eccentric pin 194 passes.

The two arcuate indentations 196 between the portions 184 and 188 each define a bearing race accommodating receipt and rotation of a plurality of ball bearings 198. The indicated races 196 continue through the full 360 degrees. The ball bearings 196 also engage the pivotable hydrofoil blade mechanism 154, as hereinafter more fully explained.

The trailing edge 200 of the bearing disc 184 is convergently tapered on each side to a thin edge 202, which enhances fluid flow.

The hydrofoil blade mechanism 154 comprises identical but opposite hand left and right hydrofoil sections which are rigidly secured together across the disc shaped partition 184 of the foot housing 152. As best illustrated in FIG. 6, the hydrofoil blade mechanism 154 comprises identical though opposed substantially planar central hub portions 210 and 212 which are of opposite hand. Each hub portion 210 and 212 comprises a tapered exposed projection 214 which are contiguously held together as by welding at site 216. Each hub portion 210 and 212 comprises aligned configurated cavities 218 shaped to accommodate the slightly spaced relation with the trailing portion of the disc 184. The opposed cavities 218 each define a curved race 220 which is contiguous with ball bearings 198.

Each hub portion 210 and 212 comprise a central region 222 which in closely spaced relation accommodates the reduced portions 186 and 188 of the disc 184. The thickened portion 222 of each hub portion 210 and 212 defines an arcuate slot 224 traversing approximately 115 arcuate degrees. The slot 224 of each hub portion 210 and 212 are aligned and accommodate loose passage of the previously described pin 194 therethrough.

Each hub portion 210 and 212 comprises a forwardly extending reduced thickness exposed portion 226 having a tapered leading end 228 which are respectively sized and shaped to loosely receive in rotatable relationship the forward portion of bearing disc or flange 184 of the foot housing 152.

The mentioned hub portions 210 and 212 are preferably formed of light weight corrosive resistant metal such as aluminum and are secured together in the illustrated position by bolts and spacers or the like (not shown) in a conventional fashion. Thus, the hub portions 210 and 212 rotate in unison as hereinafter more fully described.

The exposed leading portion 226 of each hub portion 210 and 212 merges into a laterally extending elongated support rod 230. Rods 230 are respectively secured to opposed end plates 232 at site 233 in rigid non-rotatable relation. The end plates 234 reduce vortex tip flow and are each essentially planar, vertical and shaped as best illustrated in FIG. 4. The end plates 234 are also integrally joined by a transverse rod 236 which spans continuously between the two end plates 230 and is anchored at the respective ends 238 thereof to the plates 234 in non-rotatable relation. Elongated rod 236 passes loosely through the hub portions 210 and 212 through aligned aperture 240 and 242.

Thus, the hub portions 210 and 212, the opposed left and right support rods 230, the end plates 234 and the rear elongated support rod 236 are rigidly held together as a frame for relative rotation about the foot housing disc 184, ball bearings 198 accommodating said rotation. It is to be noted that the ultimate angle of attack for both up and down movement of the hydrofoil blade assembly 150 is defined by contact between the rearwardly divergently tapered walls 214 of the hub portions 210 and 212 with the top stop shoulder 180 of the foot housing and the bottom stop shoulder 182 of the foot housing.

The hydrofoil blade mechanism 154 comprises identical though opposite hand left and right sections. Accordingly, only one section will here be described. The blade section comprises an arrow-shaped leading body portion 250, a trailing lobe-shaped body portion 252 and a central flexible sail portion 254.

The leading arrow shaped body 250 comprises a centrally disposed aperture 256 through which the previously mentioned transverse rod 230 loosely passes. Lobe body portion 252 comprises an interior aperture 258 through which transverse rod 236 loosely passes. Thus, the left and right blade sections are joined to the remainder of the pivotable hydrofoil blade mechanism 154 so as to rotate unitarily therewith, while accommodating flexure of the sail 254 and corresponding realignment of the body portions 250 and 252.

The leading end arrow head-shaped body 250 comprises forwardly diverging exposed surfaces 260 (on the top) and 262 (on the bottom). The diverging sides 260 and 262 are somewhat rounded and merge at leading edge 264. Preferably body 250 and body 252 comprise relatively rigid synthetic resinous material. The body 250 comprises a generally U-shaped concavity 266 terminating in rearwardly directed pointed tips 268 and 270.

The trailing lobe-shaped body 252 comprises exposed rearwardly divergent surfaces 272 (on the top) and 274 (on the bottom). These exposed surfaces are somewhat rounded and merge at trailing edge 276. The indicated surfaces are oppositely rounded in a forward direction merging again at concealed point 278.

The central sail 254 comprises a forward upwardly convex layer 280 of substantially flexible rubbery material which defines an eyelet 282 at the forward end and is bifurcated or forked into legs 284 and 286 at the trailing end. The legs 284 and 286 of the bifurcation are respectively integrally secured to the exterior of the body 252 at sites 288 and 290, as by bonding welding or the like. Sites 288 and 290 are approximately at the one-third point of the total front to rear length of the body 252. Thus, a hollow interior 292 is formed within the bifurcation. This is illustrated as being filled with yieldable material such as liquid.

The leading end of the hydrofoil sail 280 is fastened to the arrow head shaped forward hydrofoil body 250 in such a way as to cause and accommodate flexing of the sail region 280. More specifically, the eyelet 282 at the leading end of the sail contains an encased pin 300 to which is attached at spaced intervals wire tension loops 302. Two linked loops 302 exist at each such location, one connecting to the pin 300 and the other to an adjacent wire bridge 304, the ends of which are embedded in the trailing tapered portions 268 and 270 of the arrow head shaped body 250.

Downward movement of the mechanism 150 causes counterclockwise rotation until trailing disc 214 engages stop 180. The sail is flexed to have a top convex configuration and a bottom concave surface which causes the water flow more rapidly over the top convex surface at 280 of the right and left hydrofoil pivotable blade mechanism 154 than along the concave underside thereof. This produces improved forward thrust aiding in the propulsion of the swimmer through the water. When the direction is changed to upward movement, the left and right sections of the pivotable mechanism 154 rotate from the illustrated position clockwise through two times the angle alpha (as previously defined) until disc 214 engages stop 182. This causes the sail 280 to reverse the flexure thereof, i.e. the top becomes concave and the bottom convex with the distal links 302 sliding along the length of the wires 304. Thus, propulsion during the upward movement is also hydrofoil enhanced.

The node pin 194 which passes through the slot 224 and is also contained within the U-shaped groove 192 of the fork 186 accommodates movement of the leading hydrofoil body 250 and the pin 194 as the angle of attack changes and the sail 280 flexes during rotation of the left and right sections of the mechanism 154. In this way, there is an absence of binding during the mentioned rotation.

Figure 7:
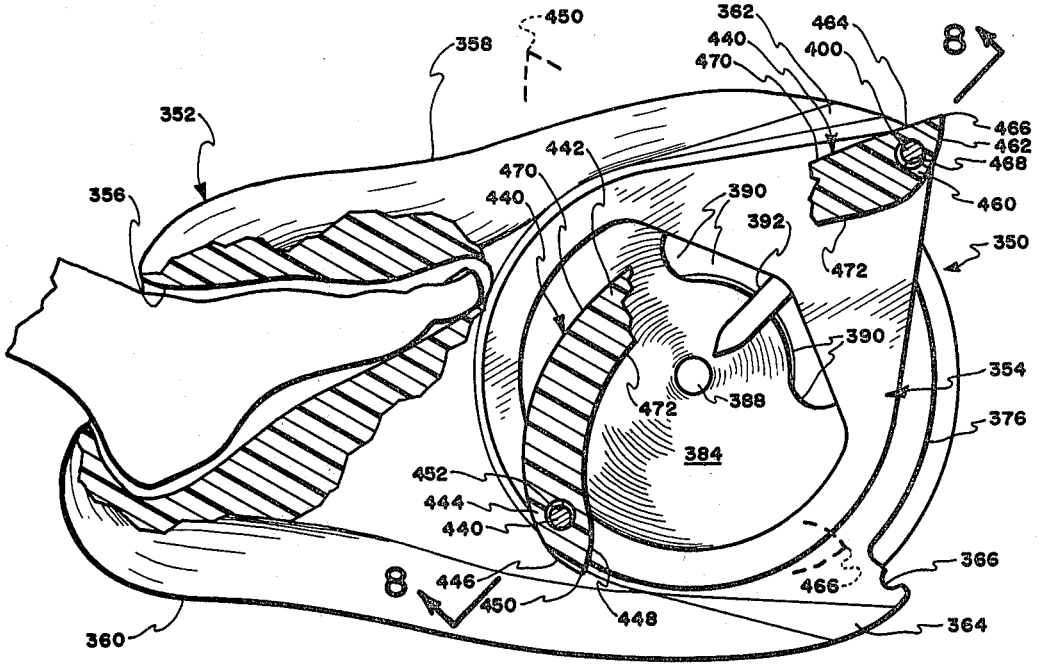
FIG. 7 is a side elevation view of a third presently preferred foot carried pivotable hydrofoil blade assembly for a swimmer, according to the present invention with some parts broken away and some parts shown in cross section for clarity.
Figure 8:
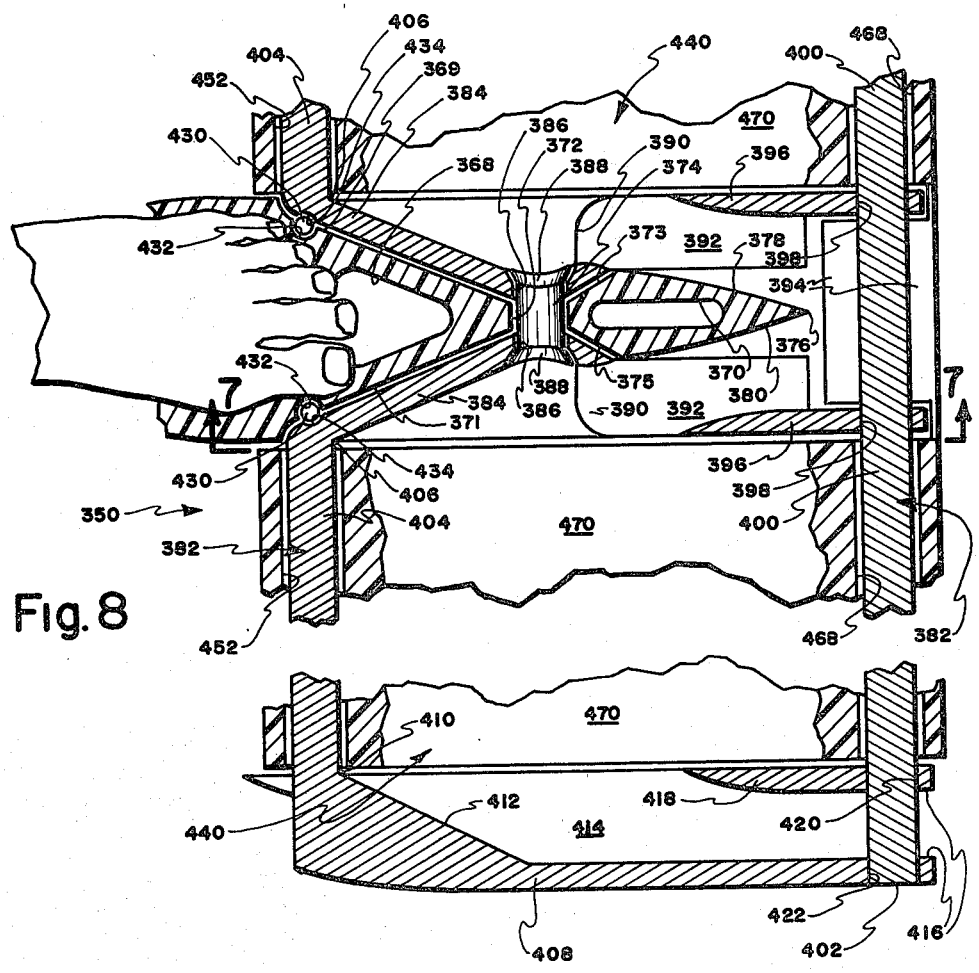
FIG. 8 is a cross sectional view of the third hydrofoil blade assembly embodiment taken along lines 8—8 of FIG. 7.

Reference is now made to FIGS. 7 and 8 which illustrate a third presently preferred embodiment, generally designated 350, according to the present invention, achieving the same objectives as the first two embodiments and providing additional streamlining structure whereby the flow of water across the top of the hydrofoil blade adjacent the edge thereof will be conveniently channeled so as to maximize water flow and lift therefrom to thereby enhance forward propulsion of the swimmer.

More specifically, FIGS. 7 and 8 illustrate a foot carried pivotable hydrofoil blade assembly for a swimmer, generally designated 350. Hydrofoil blade assembly 350 comprises a foot housing, generally designated 352, and a pivotable hydrofoil blade mechanism, generally designated 354, which rotates as described previously between plus and minus alpha degrees as the displacement of the assembly 354 is alternated between up and down strokes.

The foot housing 352 comprises a forward foot socket 356 equipped with a suitable opening and sized and shaped so as to comfortably receive the foot of the user. The exterior of the foot housing 352 is contoured for ready displacement through the water in such a fashion that water motion across the housing interacts with the hydrofoil and thus enhances forward thrust. The foot housing 352 comprises an upper central fin 358 and a less pronounced lower fin 360. The foot housing narrows near the top and bottom into substantially planar rearwardly extending exposed arms 362 and 364 which respectively define slotted stops 366 top and bottom. As hereinafter more fully described, engagement between a portion of the rotating hydrofoil blade assembly 354 and the top and bottom stops 366 position the assembly 354 in the predetermined alpha and minus alpha positions.

As best illustrated in FIG. 8, the foot housing 352 centrally narrows via diverging sides 369 and 371 and thereafter rearwardly enlarges at sides 373 and 375 and narrows at sides 378 and 380. In addition, weight saving cavities 368 and 370 are provided. The rearwardly directed portion of the foot assembly 350 is centrally apertured at 372 to provide for the required pivotal relationship between the foot housing 352 and the hydrofoil blade assembly 354. More specifically, a pivot pin 374 passes loosely through the mentioned aperture 372 (see FIG. 8). The foot housing may be formed of any rigid material. For example, shape-retaining elastomeric material which tends to retain its shape and resist wear. For example, neoprene and nylon as well as rubber both natural and synthetic may be used. Reinforcement may be provided.

A circular tapered trailing edge 376 arcuately spans between the stop surfaces 366 top and bottom in a symmetrical fashion, the divergent sides 378 and 380 (FIG. 8) merging to form the edge 376.

The pivotable hydrofoil blade mechanism 354 comprises identical though opposite hand left and right sections only one of which needs to be described. A single rigid frame, generally designated 382, supports both sections. The frame 382 on each side integrally comprises a partially cone shaped hub 384, equipped with a central aperture 386 through which the previously mentioned pin 374 passes and is there secured by an enlarged head 388.

The trailing end of the partial cone-shaped hub 384 is recessed at reverse curve cavity 390 to direct the discharge of water flowing over the hydrofoil blade assembly near the center so as to slow water flow under the hydrofoil concave section. Water reaching the cavity 390 flows along the cavity, flows past the support web 392 and thence centrally out of the hydrofoil blade mechanism 354 at rear central opening 394. A baffle 396, tapered at its forward edge aids in deflecting the water at the edge of the hydrofoil blade toward the center of the mechanism. The baffle plate 396 is integrally joined at aperture 398 to a transverse shaft 400 which spans the entire transverse dimension of the hydrofoil blade mechanism 354 terminating in opposed end 402.

The partial cone-shaped hub 384 on each side integrally merges with a forward shaft 404 the merger occuring at site 406. The shaft 404 is integrally joined to a flow facilitating hydrofoil blade tip 408 at site 410. Tip mechanism 408 comprises an internal partial cone shaped section 412 into which water at the lateral tip of the hydrofoil blade mechanism is caused to flow for the purpose of slowing flow under the hydrofoil blade, the flow thereafter continuing along a rearwardly directed channel 414 and from the mechanism 354 via opening 416. Baffle plate 418, which is tapered at its forward end aids in deflecting the mentioned water flow outwardly to reduce flow under the concave hydrofoil blade. Baffle plate 408 is integrally secured at aperture 420 to the transverse rod 400. Flow control tip structure 408 is also integrally joined to the end 402 of the transverse rod 400 at aperture 422.

Ball bearings 430 are interposed between foot housing races 432 and the two sides of the frame of the pivotable hydrofoil blade mechanism 354 at race sites 434 to maintain alignment and facilitate the mentioned rotation between plus and minus alpha degrees.

Each right and left section of the pivotable hydrofoil blade mechanism 354 comprise a hydrofoil blade or sail 440 comprising a relatively narrow flexible central portion 442, illustrated as being formed of synthetic resinous material and terminating in a front tapered nose 444 comprising divergent top and bottom surfaces 446 and 448 merging at leading edge 450. The front body portion 444 comprises an aperture 452 through which shaft 404 loosely passes.

The trailing end of the hydrofoil blade 440 of each section comprises a body 460, the side surfaces 462 and 464 merging into trailing edge 466. The trailing body 460 defines a transverse aperture 468 through which the rod 400 loosely passes. Thus, the hydrofoil sail 442 is held in the arcuate position best illustrated in FIG. 7 during the down-stroke and is caused to rotate to the minus alpha degree position by the motion imparted to the assembly 350 by the foot of the user at the beginning of the up-stroke. At this time the central portion 442 of the sail is caused to flex so that the top surface becomes concave and the bottom convex. Again, as explained above, the water is displaced across the convex surface of the central portion 442 more rapidly thus reducing pressure and slow flow across the concave surface increasing pressure to create hydrofoil lift thereby adding to the propulsion of the swimmer through the water during both the down and the up-stroke.

The invention may be embodied in other specific forms without departing from the spirit or essential characteristics thereof. The present embodiments are therefore considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A hydrofoil swim fin apparatus comprising:

foot receiving housing means;

hydrofoil means disposed to the rear of the housing means;

means pivotably connecting the hydrofoil means to the housing means;

means defining the magnitude of clockwise and counterclockwise rotation through which the hydrofoil means may pivot in respect to the housing means;

the hydrofoil means comprising blade means comprising (a) leading edge means which divides the relative displacement of water across the blade means into upper and lower water portions, (b) trailing edge means where the upper and lower water portions merge and (c) central flexure means associated with both the leading and trailing edge means and comprising variable curvature means which are caused to flex between convex and concave configurations during up and down strokes of the apparatus to enhance propulsion of the user through the water during both the up and the down-strokes through hydrofoil action;

the blade means comprise two opposed sections rotatably joined at a central hub to the housing means and means between said sections adjacent the central hub sized and shaped to enhance liquid flow across the outwardly flexed portion of the central flexure means and to inhibit liquid flow across the inwardly flexed portion of the central flexure means.

2. A hydrofoil swim fin apparatus according to claim 1 wherein said sized and shaped means comprise opposed partial cone-shaped hub portions.

3. A hydrofoil swim fin apparatus comprising:

foot receiving housing means;

hydrofoil means disposed to the rear of the housing means;

means pivotably connecting the hydrofoil means to the housing means;

means defining the magnitude of clockwise and counterclockwise rotation through which the hydrofoil means may pivot in respect to the housing means;

the hydrofoil means comprising leading edge means which divides the relative displacement of water across the hydrofoil means into upper and lower water portions, trailing edge means where the upper and lower water portions merge with central flexure means associated with both the leading and trailing edge means and comprising variable curvature means which are caused to flex between convex and concave configurations during up and down strokes of the apparatus to enhance propulsion of the user through the water during both the up and the down strokes through hydrofoil action;

the leading edge means having a narrow leading edge, rearwardly divergently tapered top and bottom surfaces and a relatively thick trailing portion;

the forward part of the central flexure means being substantially less in thickness than the trailing portion of the leading edge means, the forward part of the central flexure means being simultaneously translated up and down and reverse flexed each time the stroke is reversed;

the trailing portion of the leading edge means and the forward part of the central flexure means being so sized, shaped and arranged that alignment exists between the convex surface of the central flexure means and one said tapered surface of the leading edge means and at the same time discontinuity exists between the concave surface of the central flexure means and the other tapered surface of the leading edge means during any up or down stroke.

4. A hydrofoil swim fin apparatus comprising:

foot receiving housing means;

hydrofoil means disposed to the rear of the housing means;

means pivotably connecting the hydrofoil means to the housing means;

means defining the magnitude of clockwise and counterclockwise rotation through which the hydrofoil means may pivot in respect to the housing means;

the hydrofoil means comprising leading edge means which divides the relative displacement of water across the hydrofoil means into upper and lower water portions, trailing edge means where the upper and lower water portions merge and central flexure means associated with both the leading and trailing edge means and comprising variable curvature means which are caused to flex between convex and concave configurations during up and down strokes of the apparatus to enhance propulsion of the user through the water during both the up and the down strokes through hydrofoil action;

the leading edge means comprising a thin leading edge and which merges into a body of material having substantial thickness when viewed in cross section;

the central flexure means being thin and flexible, the thickness thereof in cross section being much less than the thickness of the body of the leading edge means;

the central flexure means comprising means translated up and down during said respective strokes concurrent with the flexing of the central flexure means to create surface continuity between the convex surface of the central flexure means and the leading edge means and surface discontinuity between the concave surface of the central flexure means and the leading edge means.

5. A hydrofoil swim fin apparatus comprising:

foot receiving housing means;

hydrofoil means disposed to the rear of the housing means;

means pivotably connecting the hydrofoil means to the housing means;

means defining the magnitude of clockwise and counterclockwise rotation through which the hydrofoil means may pivot in respect to the housing means;

the hydrofoil means comprising blade means comprising (a) leading edge means which divides the relative displacement of water across the blade means into upper and lower water portions, (b) trailing edge means where the upper and lower water portions merge and (c) central flexure means associated with both the leading and trailing edge means and comprising variable curvature means which are caused to flex between convex and concave configurations during up and down strokes of the apparatus to enhance propulsion of the user through the water during both the up and the down-strokes through hydrofoil action;

the blade means comprise section means rotatably joined at a hub to the housing means and means associated with said section means adjacent the hub sized and shaped to enhance liquid flow across the outwardly flexed portion of the central flexure means and to inhibit liquid flow across the inwardly flexed portion of the central flexure means.

6. A hydrofoil swim fin apparatus according to claim 5 wherein the hub comprises a generally concave partial cone comprising recess means to discharge water at the rear.

7. A hydrofoil swim fin apparatus according to claim 6 wherein support web means bridge between rear edges of the concave partial cone and wherein the web controls the flow of water crossing the partial cone.

8. A hydrofoil swim fin apparatus according to claim 3 wherein the foot housing shape is complimentary to said hub.

9. A hydrofoil swim fin apparatus according to claim 5 wherein the foot housing has weight saving cavity means.

10. A hydrofoil swim fin apparatus comprising:

foot receiving housing means;

hydrofoil means disposed to the rear of the housing means;

means pivotably connecting the hydrofoil means to the housing means;

means defining the magnitude of clockwise and counterclockwise rotation through which the hydrofoil means may pivot in respect to the housing means;

the hydrofoil means comprising blade means comprising (a) leading edge means which divides the relative displacement of water across the blade means into upper and lower water portions, (b) trailing edge means where the upper and lower water portions merge and (c) central flexure means associated with both the leading and trailing edge means and comprising variable curvature means which are caused to flex between convex and concave configurations during up and down strokes of the apparatus to enhance propulsion of the user through the water during both the up and the down strokes through hydrofoil action;

the hydrofoil means further comprising blade tip means, said blade tip means having an internal partial cone shape and including channel means, said blade tip means being located outwardly of the extreme transverse tips of the blade means, said blade tip means enhancing liquid flow across the outwardly flexed portion of the central flexure means and inhibiting liquid flow across the inwardly flexed portion of the central flexure means.

* * * * *